United States Patent [19]

Jarnot

[11] Patent Number: 4,898,085

[45] Date of Patent: Feb. 6, 1990

[54] PUSH-IN FLEXIBLE COVER VENT

[75] Inventor: Frank R. Jarnot, Lantana, Fla.

[73] Assignee: Airlette Manufacturing Corporation, Lantana, Fla.

[21] Appl. No.: 275,716

[22] Filed: Nov. 23, 1988

[51] Int. Cl.[4] ..... F24F 7/00

[52] U.S. Cl. ..... 98/1; 98/37; 135/93

[58] Field of Search ..... 98/1, 6, 37, 52; 135/93; 2/DIG. 1

[56] References Cited

U.S. PATENT DOCUMENTS 3,004,483 10/1961 Prager et al. ..... 98/37
3,164,078 1/1965 Sheng ..... 135/93 X

FOREIGN PATENT DOCUMENTS 1423981 11/1964 Fed. Rep. of Germany ..... 135/93

*Primary Examiner*—Harold Joyce
*Attorney, Agent, or Firm*—Fleit, Jacobson, Cohn, Price, Holman & Stern

[57] ABSTRACT

A pair of similarly transversely bowed and superposed panel members are secured together and are V-shaped in plan. The apex portion of one panel member disposed to the concave side of the other panel member is sharpened and the panel members are secured together along their base edge portions with the remaining portions of the panel members disposed in slightly spaced apart relation. The opposing surfaces of the spaced apart portions of the panel members include coacting projections for frictionally clampingly engaging the portion of a flexible cover disposed to one side of a slit formed in the cover through which the aforementioned one panel member extends.

15 Claims, 2 Drawing Sheets

FIG. 5
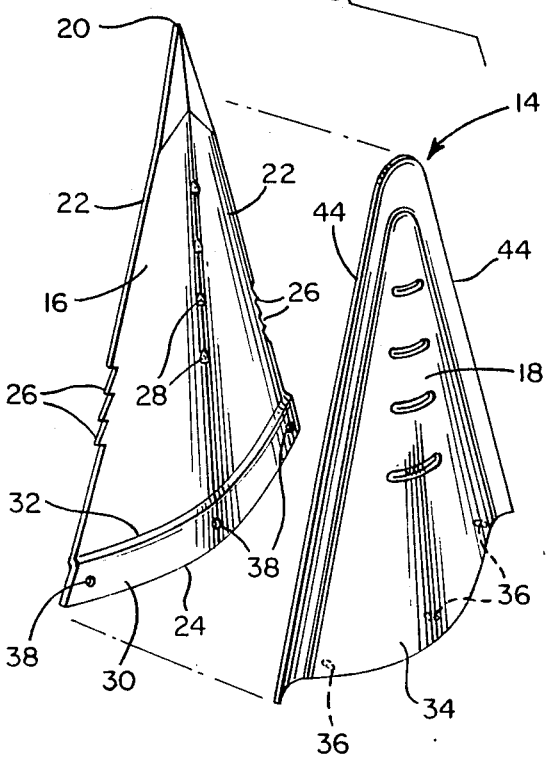
FIG. 7
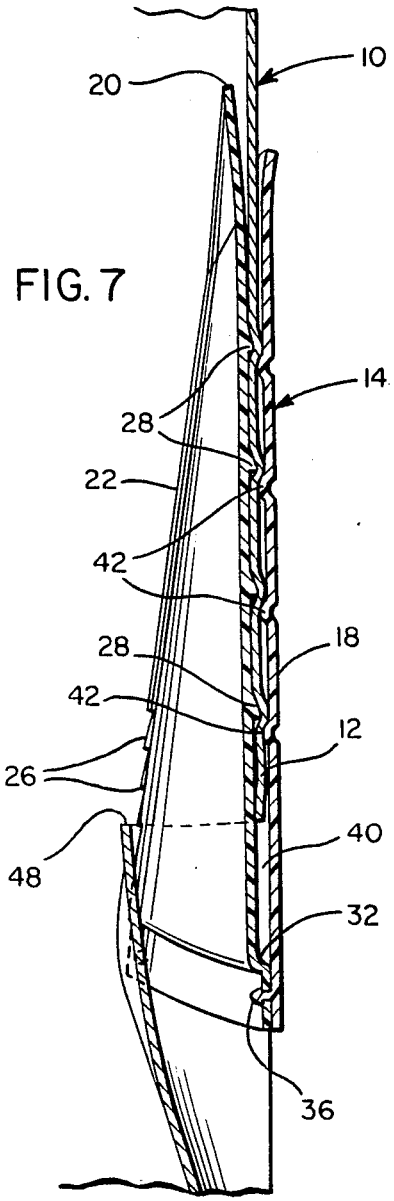
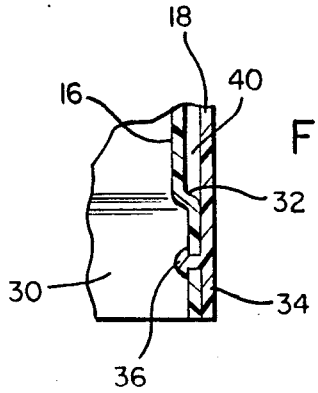
FIG. 6
FIG. 8
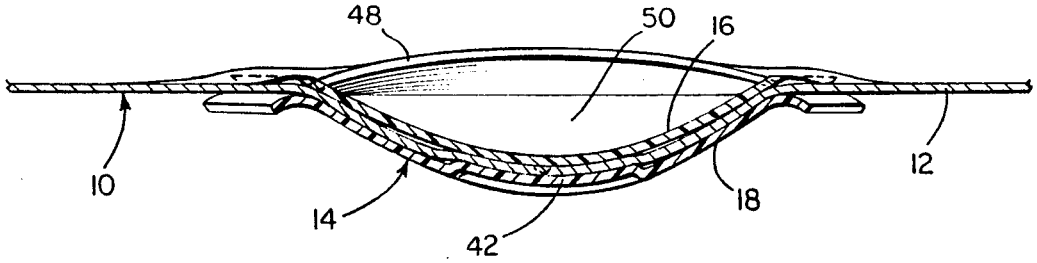

PUSH-IN FLEXIBLE COVER VENT

BACKGROUND OF THE INVENTION

1. FIELD OF THE INVENTION

This invention relates to a vent construction to be used in conjunction with flexible covers such as those used to cover materials and/or equipment at a job site or manufacturing plant and the like. The vent construction includes a pointed and sharp edge equipped panel portion which may be used to pierce and form a cut in a flexible cover area to be vented and the pointed and sharp edge equipped panel portion of the vent construction is bowed and closely opposed by a similar bowed panel portion whereby the portion of the cover disposed along one side of the cut may be frictionally clamped between the panel portions and bowed thereby relative to the portion of the flexible cover on the opposite side of the cut, thus forming a ventilation opening in the flexible cover.

2. DESCRIPTION OF RELATED ART

Various different forms of vents for flexible covers heretofore have been provided such as those disclosed in U.S. Pat. Nos. 38,583, 3,024,717, 3,164,078, 3,380,370 and 4,043,085. However, these previously known forms of cover vents are specifically designed to be used in conjunction with specially constructed covers, whereas the vent construction of the instant invention may be used in conjunction with substantially any flexible cover capable of being pierced and cut by a pointed and sharp edged implement.

SUMMARY OF THE INVENTION

Inexpensive flexible covers are used in many different environments for protecting equipment or supplies under the cover. The cover may be of a type so inexpensively constructed such that the cover may be discarded after its use. On the other hand, the cover may be more expensively manufactured for repeated usage over a relatively long period of time.

However, many covers should be provided with vents to allow air circulation beneath the cover and thus prevent damage to the materials or equipment disposed under the cover by excess moisture. It is this type of cover for which the vent construction of the instant invention has been specifically designed.

The main object of this invention is to provide a vent construction which may be used to form a vent opening in a flexible cover and to retain the vent opening in a fully open position at all times.

Still another object of this invention is to provide a vent construction which may be used in conjunction with variously constructed flexible covers.

Another object of this invention is to provide a vent construction in accordance with the preceding objects and which does not require the use of tools to accomplish installation of the vent construction on a flexible cover.

A further object of this invention is to provide a vent construction which may be installed in an associated flexible cover by inexperienced personnel.

A final object of this invention to be specifically enumerated herein is to provide a vent construction in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is an exploded perspective view of the cover vent.

FIG. 6 is an enlarged fragmentary sectional view illustrating the manner in which the two panel portions or members of the cover vent may be secured together.

FIG. 7 is an enlarged vertical sectional view taken substantially upon the plane indicated by the section line 7—7 of FIG. 1.

FIG. 8 is an enlarged fragmentary horizontal sectional view taken substantially upon a plane indicated by the section line 8—8 of FIG. 7.

DESCRIPTION OF THE PREFERRED EMBODIMENT

Figure 1:
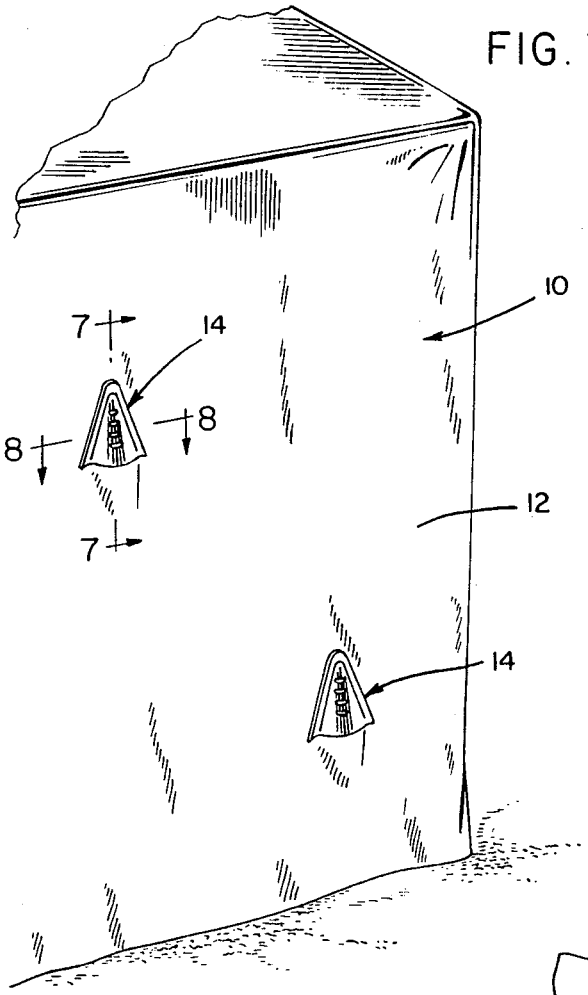
FIG. 1 is a fragmentary perspective view of a flexible cover disposed over a quantity of materials or equipment and with two cover vents or vent constructions of the instant invention operatively associated therewith.

Referring now more specifically to the drawings, the numeral 10 generally designates a flexible cover disposed over equipment or supplies (not shown) and including a cover section 12 having two air circulation vents constructed in accordance with the present invention operatively associated therewith, the vents being generally designated by the reference numeral 14.

Figure 2:
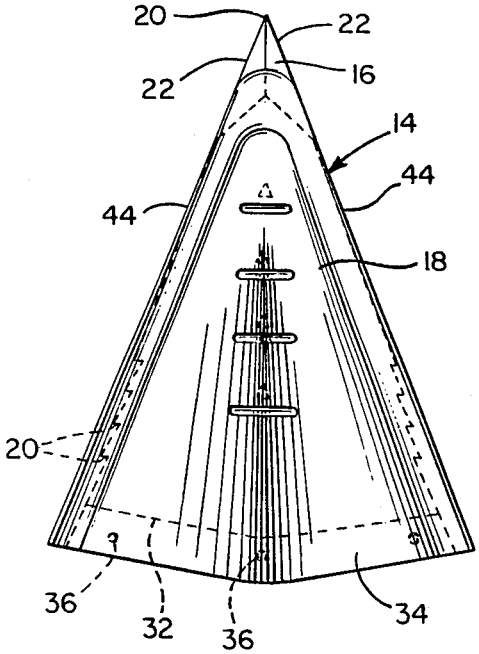
FIG. 2 is an enlarged plan view of one of the cover vents.
Figure 3:
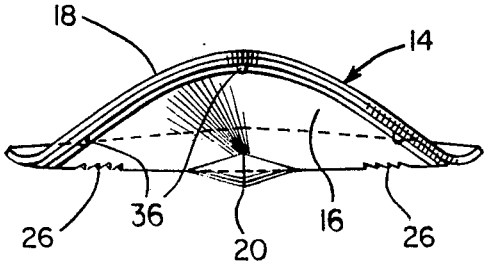
FIG. 3 is an enlarged end elevational view of one of the cover vents as seen from the open end thereof.
Figure 4:
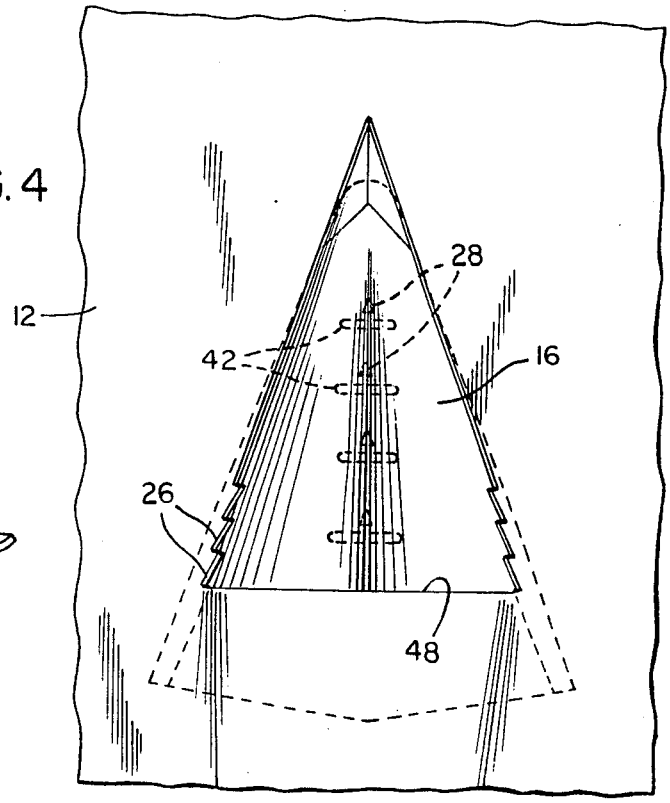
FIG. 4 is an enlarged elevational view of one of the vents illustrated in FIG. 1 as seen from the inner side of the cover.

With reference now more specifically to FIGS. 2, 3 and 5 of the drawings, it may be seen that each vent 14 includes first and second stiff panel members 16 and 18. The panel members may be constructed of any suitable material such as plastic, metal or fiberglass, but the vents 14 are illustrated as constructed of plastic.

Each of the panel members 16 and 18 is generally triangular in configuration. The apex portion 20 of the panel member 16 is pointed and the edges 22 thereof extending from the apex portion 20 to the base edge 24 of the base edge marginal portion 30 of the panel member 16 may be considered as somewhat sharpened and as comprising, together with the apex portion 20, a second marginal portion opposite the base edge marginal portion 30. Also, the intermediate length portions of the edges 22 each is provided with longitudinally spaced teeth 26 inclined toward the base edge 24. Also, it will be noted that the panel member 16 is smoothly arched throughout the length of its base edge 24 and for the full extent of the panel member 16 from the base edge 24 to the apex portion 20. The center zone of the panel member 16 extending from the apex portion 20 to the longitudinal mid-portion of the base edge 24 is provided with longitudinally spaced detents 28 which project outward from the convex surface of the panel member 16 and the base edge marginal portion 30 of the panel member 16 is laterally offset relative to the remainder of the panel member 16 from the convex side of the remainder of the panel member 16 and thus defines a ridge 32 on the convex side of the panel member 16 facing toward the apex portion 20 and extending along the inner extremity of the base edge marginal portion 30.

The second panel member !8 is also triangular in shape and is disposed in superposed relation over the panel member 16 with the base edge marginal portion 34 of the panel member 18 secured to the base edge marginal portion 30 through the utilization of a plurality of studs carried by the base edge marginal portion 34 and secured through apertures 38 provided therefor in the base marginal edge portion 30. The studs 36 are illustrated as formed integrally with the second panel member 18, but the studs 36 may be replaced by rivets or other suitable fasteners secured through the apertures 38 and corresponding apertures (not shown) formed in the base edge marginal portion 34 in lieu of the studs 36. In addition, if the panel members 16 and 18 are constructed of metal, spot welds (not shown) may be used in lieu of the studs 36 and the apertures 38 need not be provided.

Because of the ridge 32 and the fact that the panel member 18 is also curved in the same manner as the panel member 16, a smoothly curved or arched space 40 is defined between the panel members 16 and 18 between the ridge 32 and the apex portion 20. The detents 28 project into the space 40 and the concave side of the second panel member 18 is provided with a plurality of ridges 42 as companion projections into the space 40 with the detents 28 but which are slightly out of registry with the ridges 42.

Also, from FIGS. 3, 5 and 7 of the drawings, it may be seen that the edges 44 of the panel member 18 corresponding to the edges 22 are reversely curved away from the opposing edges 22.

When it is desired to install one of the vents 14 in the cover section 12, the vent 14 is held against the cover section 12 in a slightly inclined position with the panel member 16 closely adjacent the outer surface of the cover section 12 and the apex portion 20 engaged with the cover section 12. Then, with the cover 14 inclined relative to the cover section 12 such that the base edge marginal portion is spaced slightly outward of the outer surface of the cover section 12, the vent 14 is forced upward relative to the cover section 12 whereupon the pointed apex portion 20 will penetrate the cover section 12 and the edges 22 will coact with the pointed apex portion 20 in order to form a generally horizontal cut 48 in the cover section 12. The apex portion of the panel member 18 is retained on the outer side of the cover section 12 as the vent 14 is further upwardly displaced relative to the cover section 12 and after one, two, three or four of the teeth 26 have passed through the cut 48, upward movement of the vent 14 relative to the cover section 12 may be terminated, that portion of the cover section 12 disposed immediately above the cut 48 being frictionally clamped between the upper portions of the panel members 14 and 16 and between the detents 28 and ridges 42. In this manner, the coacting detents 28 and ridges 42 as well as the last teeth 26 passing through the cut 48 will retain the vent 14 in position on the cover section 12. Furthermore, that portion of the cover section 12 disposed above the cut 48 and frictionally gripped between the upper portions of the panel members 16 and 18 is arched in the manner illustrated in the lower portion of FIG. 8 to define the ventilation opening 50 illustrated in FIG. 8 through which ventilating air may pass from the exterior of the cover 10 to the interior thereof for the purpose of evaporating any moisture beneath the cover 10.

If it is desired, the panel member 16 may be inserted through the cut 48 such that all of the teeth 26 are spaced above the cut 48 and that portion of the cover section 12 disposed above the cut 48 is seated in the bottom of the space 40 against the ridge 32. However, with the vent mounted on the cover section 12 as illustrated in FIG. 7 with the cut 48 disposed immediately below the lowermost teeth 26, rain falling on the outer surface of the cover section 12 and passing beneath the second panel member 18 will not have access to the interior of the cover 10, inasmuch as such water will collect in the lower portion of the space 40 below the cut 48 and then drain outward of the lower portion of the space 40 at the opposite ends of the ridge 32. Therefore, it may be seen that it is important that the vents 14 are mounted with the apex portions of the panel members 16 and 18 thereof uppermost.

The vents 14 may be used in conjunction with single ply film plastic covers, fiberglass reinforced plastic covers and nylon or canvas covers, etc. Further, although it is envisioned that the vents 14 will be utilized in conjunction with relatively inexpensive disposable covers, they may of course be utilized in conjunction with more expensive and durable reusable covers. Also, one of the most important aspects of the vent 14 is that it may be installed on a semi-permanent cover disposed over a given shaped object in any desired position on the cover. Thus, the vent 14 may be strategically positioned on boat covers after the covers have been draped over boats of different configurations with the positional mounting of the vents 14 being selected such as to prevent their mounting on portions of the cover which might experience puddling of rain water.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a flexible cover section having an elongated opening formed therein, said cover section defining opposing elongated free edge portions extending longitudinally of said opening, an air circulation vent, said vent including first and second stiff panel members disposed in superposed relation and including corresponding pairs of first and second opposite marginal portions, said first marginal portions being secured together along an elongated zone extending longitudinally along said first marginal portions, said second marginal portions being closely laterally spaced apart, said first panel member having its second marginal portion projected through said opening with one of said free edge portions received between said first marginal portions of said panel members and disposed at least closely adjacent and paralleling said zone, said panel members being similarly and complimentarily laterally contoured, substantially throughout, such that the opposite ends of said zone are contained in a first plane appreciably spaced from a second plane containing the longitudinal mid-portion of said zone, paralleling said first plane and spaced to the side of the latter in the same direction said second panel member is displaced from said first panel member, said one free edge portion being clampingly received between said second marginal portions and the other free edge portion extending over the side surface of said first panel member remote from said second panel member.

2. The cover section and vent combination of claim 1 wherein said second marginal portion of said first panel member is generally V-shaped in plan and, thus, includes a V-shaped edge, the apex of said edge being spaced furthest from said zone.

3. The cover section and vent combination of claim 2 wherein said V-shaped second marginal portion of said first panel member includes a somewhat sharpened edge.

4. The cover section and vent combination of claim 3 wherein said apex is pointed for penetrating said cover section and said pointed apex and the remaining portions of said sharpened edge are operative to penetrate said cover section and cut the latter to form said opening during installation of said vent on said cover section.

5. The cover section and vent combination of claim 1 wherein said contour of said panel members comprises an accurate contour extending along said zone.

6. The cover section and vent combination of claim 4 wherein said remaining portions of said sharpened edge include at least portions thereof provided with longitudinally spaced teeth inclined toward said zone.

7. The cover section and vent combination of claim 6 wherein said contour of said panel members comprises an arcuate contour extending along said zone.

8. The cover section and vent combination of claim 1 wherein the opposing surfaces of said second marginal portions of said panel members include staggered projections and recesses spaced therealong along a second zone extending at generally right angles relative to and away from the first mentioned zone and said staggered projections and recesses serve to frictionally grip said one of said free edge portions between said second marginal portions of said panel members.

9. A flexible cover vent including superposed first and second stiff panel members incorporating corresponding first and second opposite marginal portions, said first marginal portions being secured together along an elongated zone extending longitudinally of said first marginal portions, said panel members being laterally bowed, substantially throughout, in the direction extending along said zone, said second marginal portions of said panel members being closely spaced apart and adapted to frictionally clampingly receive a flexible cover section margin therebetween extending along one free edge portion of said cover section defining one longitudinal margin of a narrow slit opening formed in said cover section and with said one free edge portion supported in bowed condition between said second marginal portions.

10. The cover vent of claim 9 wherein said second marginal portions include border edges which are V-shaped in plan with the apex portions thereof spaced furthest from said zone.

11. The cover vent of claim 10 wherein said border edges one of said panel members are at least somewhat sharpened.

12. The cover vent of claim 11 wherein the apex portion of said one of said panel members is pointed for forceful penetration of an associated flexible cover.

13. The cover vent of claim 11 wherein the apex portion of the other of said panel members is rounded and curved, laterally, away from said one panel member.

14. The cover vent of claim 11 wherein the opposing surfaces of said superposed panel members include coacting outwardly projecting detents and recesses for increasing the frictional grip of said panel members on said flexible cover section margin.

15. The cover vent of claim 11 wherein said border edges include longitudinally spaced teeth inclined toward said zone.

* * * * *